US009906872B2

(12) United States Patent
Odame et al.

(10) Patent No.: US 9,906,872 B2
(45) Date of Patent: Feb. 27, 2018

(54) HEARING-AID NOISE REDUCTION CIRCUITRY WITH NEURAL FEEDBACK TO IMPROVE SPEECH COMPREHENSION

(71) Applicant: The Trustees of Dartmouth College, Hanover, NH (US)

(72) Inventors: Kofi Odame, Hanover, NH (US); Valerie Hanson, Medford, MA (US)

(73) Assignee: THE TRUSTEES OF DARTMOUTH COLLEGE, Hanover, NH (US)

( * ) Notice: Subject to any disclaimer, the term of this patent is extended or adjusted under 35 U.S.C. 154(b) by 6 days.

(21) Appl. No.: 14/900,457

(22) PCT Filed: Jun. 20, 2014

(86) PCT No.: PCT/US2014/043369
§ 371 (c)(1),
(2) Date: Dec. 21, 2015

(87) PCT Pub. No.: WO2014/205327
PCT Pub. Date: Dec. 24, 2014

(65) Prior Publication Data

US 2016/0157030 A1 Jun. 2, 2016

Related U.S. Application Data

(60) Provisional application No. 61/838,032, filed on Jun. 21, 2013.

(51) Int. Cl.
*H04R 25/00* (2006.01)

(52) U.S. Cl.
CPC ..... *H04R 25/505* (2013.01); *H04R 25/407* (2013.01); *H04R 25/43* (2013.01);
(Continued)

(58) Field of Classification Search
CPC ..... H04R 2225/67; H04R 25/505; H04R 25/407; H04R 25/43; H04R 25/554; H04R 2225/43
(Continued)

(56) References Cited

U.S. PATENT DOCUMENTS 6,330,339 B1 * 12/2001 Ishige ..... H04R 25/502 381/312
2007/0219784 A1 * 9/2007 Zhang ..... H04R 25/505 704/200.1
(Continued)

OTHER PUBLICATIONS

International Preliminary Report on Patentability corresponding to International Patent Application No. PCT/US2014/043369, dated Dec. 22, 2015.
(Continued)

*Primary Examiner* — Sunita Joshi
(74) *Attorney, Agent, or Firm* — Lathrop Gage LLP

(57) ABSTRACT

A hearing prosthetic has microphones configured to receive audio with signal processing circuitry for reducing noise; apparatus configured to receive a signal derived from a neural interface, and to determine an interest signal when the user is interested in processed audio; and a transducer for providing processed audio to a user. The signal processing circuitry is controlled by the interest signal. In particular embodiments, the neural interface is electroencephalographic electrodes processed to detect a P300 interest signal, in other embodiments the interest signal is derived from a sensorimotor rhythm signal. In embodiments, the signal processing circuitry reduces noise by receiving sound from along a direction of focus, while rejecting sound from other directions; the direction of focus being set according to timing of the interest signal. In other embodiments, a sensorimotor rhythm signal is determined and binned, with direction of audio focus set according to amplitude.

10 Claims, 8 Drawing Sheets

(52) U.S. Cl.
CPC ..... *H04R 25/554* (2013.01); *H04R 2225/43* (2013.01); *H04R 2225/67* (2013.01)

(58) Field of Classification Search
USPC ..... 381/312–321, 74; 600/25, 554
See application file for complete search history.

(56) References Cited

U.S. PATENT DOCUMENTS

| | | | | |
|---|---|---|---|---|
| 2007/0269064 | A1* | 11/2007 | Allegro-Baumann | H04S 3/008 381/313 |
| 2010/0074460 | A1* | 3/2010 | Marzetta | G02C 11/06 381/313 |
| 2010/0196861 | A1 | 8/2010 | Lunner | |
| 2010/0324440 | A1 | 12/2010 | Moore et al. | |
| 2011/0307079 | A1 | 12/2011 | Oweiss et al. | |
| 2013/0138012 | A1 | 5/2013 | Morikawa et al. | |
| 2013/0195296 | A1* | 8/2013 | Merks | H04R 25/402 381/313 |
| 2013/0343585 | A1* | 12/2013 | Bennett | H04R 25/554 381/315 |

OTHER PUBLICATIONS

International Search Report with Written Opinion corresponding to International Patent Application No. PCT/US2014/043369, dated Oct. 30, 2014.

* cited by examiner

HEARING-AID NOISE REDUCTION CIRCUITRY WITH NEURAL FEEDBACK TO IMPROVE SPEECH COMPREHENSION

PRIORITY CLAIM

The present document claims priority to U.S. Provisional Patent Application 61/838,032 filed 21 Jun. 2013, the contents of which are incorporated herein by reference.

GOVERNMENT INTEREST

The work described herein was supported by the National Science Foundation under NSF grant number 1128478. The Government has certain rights in this invention.

FIELD

The present document relates to the field of hearing prosthetics, such as hearing aids and cochlear implants that use electronic sound processing for noise-suppression. These prosthetics process an input sound to present a more intelligible version that is presented to a user.

BACKGROUND

There are many causes of hearing impairments, particularly common causes include the history of exposure to loud noises (including music) of a large portion of the population, and presbyacousis (the decline of hearing with age). These, combined with the increasing average age of people in the United States and Europe, is causing the population of hearing-impaired to soar.

Oral communication is fundamental to our society. Hearing-impaired people frequently have difficulties understanding oral communication; most hearing-impaired people consider this communication difficulty the most serious consequence of their hearing impairment. Many hearing-impaired people wear and use hearing prosthetics, including hearing aids or cochlear implants and associated electronics, to help them understand other's speech, and thus to communicate more effectively. They often, however, still have difficulty understanding speech, particularly when there are multiple speakers in a room, or when there are background noises. It is expected that reducing background noise, including suppressing speech sounds from people other than those a wearer is interested in communicating with, will help these people communicate.

While many hearing-aids are omnidirectional—receiving audio from all directions equally, directional hearing-aids are known. Directional hearing-aids typically have a directional microphone that can be aimed in a particular direction; for example a user can aim a directional wand at a speaker of interest to him, or can turn his head to aim a directional microphone attached to his head, such as a microphone in a hearing-aid, at a speaker of interest. Other hearing-aids have a short-range radio receiver, and the wearer can hand a microphone with short-range radio transmitter to the speaker of interest. Some users report improved ability to communicate with such devices that reduce ambient noises.

Some systems described in the prior art have the ability to adapt their behavior according to changes in the acoustic environment. For example, a device might perform in one way if it perceives that the user is in a noisy restaurant, and might perform in a different way if it perceives that the user is in a lecture hall. However typical prior devices response to an acoustic environment might be inappropriate for the specific user or for the user's current preferences.

Other prior devices include methods to activate or deactivate processing, depending on the user's cognitive load. These methods represent some form of neural feedback control from the user to the hearing device. However, the control is coarse, indeed binary, with enhancement either on or off. Further, prior devices known to the inventors do not enhance the performance of the processing in producing a more intelligible version of the input sound for the user.

SUMMARY

A hearing prosthetic has microphones configured to receive audio with signal processing circuitry for reducing noise in audio received from the microphones, apparatus configured to receive a signal derived from a neural interface, and to determine an interest signal when the user is interested in processed audio; where the signal processing circuitry is controlled by the interest signal; and transducer apparatus configured to present processed audio to a user. In particular embodiments, the neural interface is an electroencephalographic electrode, processed according to detect a P300 signal. In embodiments, the signal processing circuitry reduces noise by preferentially receiving sound from along a direction of audio focus, while rejecting sound from other directions, and the direction of audio focus is set according to when the interest signal becomes active. In other embodiments, a sensorimotor rhythm signal amplitude is determined and binned. In a particular embodiment, whenever the direction of interest is updated, the direction of audio focus is set according to the current amplitude bin of the sensorimotor rhythm signal.

In an embodiment, a hearing prosthetic has microphones configured to receive audio with signal processing circuitry for reducing noise in audio received from the microphones, apparatus configured to receive a signal derived from a neural interface, and to determine an interest signal when the user is interested in processed audio; where the signal processing circuitry is controlled by the interest signal; and transducer apparatus configured to present processed audio to a user.

In another embodiment, a hearing prosthetic has signal processing circuitry configured to receive audio along a direction of audio focus while rejecting at least some audio received from directions not along the direction of audio focus, the signal processing circuitry configured to derive processed audio from received audio; transducer apparatus configured to present processed audio to a user; the signal processing circuitry further configured to receive an EEG signal, and to determine an interest signal when the EEG signal shows the user is interested in processed audio; wherein the prosthetic is adapted to rotate the direction of audio focus when the interest signal is not present, and to stabilize the direction of audio focus when the interest signal is present.

In yet another embodiment, A method of processing audio signals in a hearing aid includes processing neural signals to determine a control signal; receiving audio; processing the audio according to a current configuration; and adjusting the current configuration in accordance with the control signal.

DETAILED DESCRIPTION OF THE EMBODIMENTS

Figure 1:
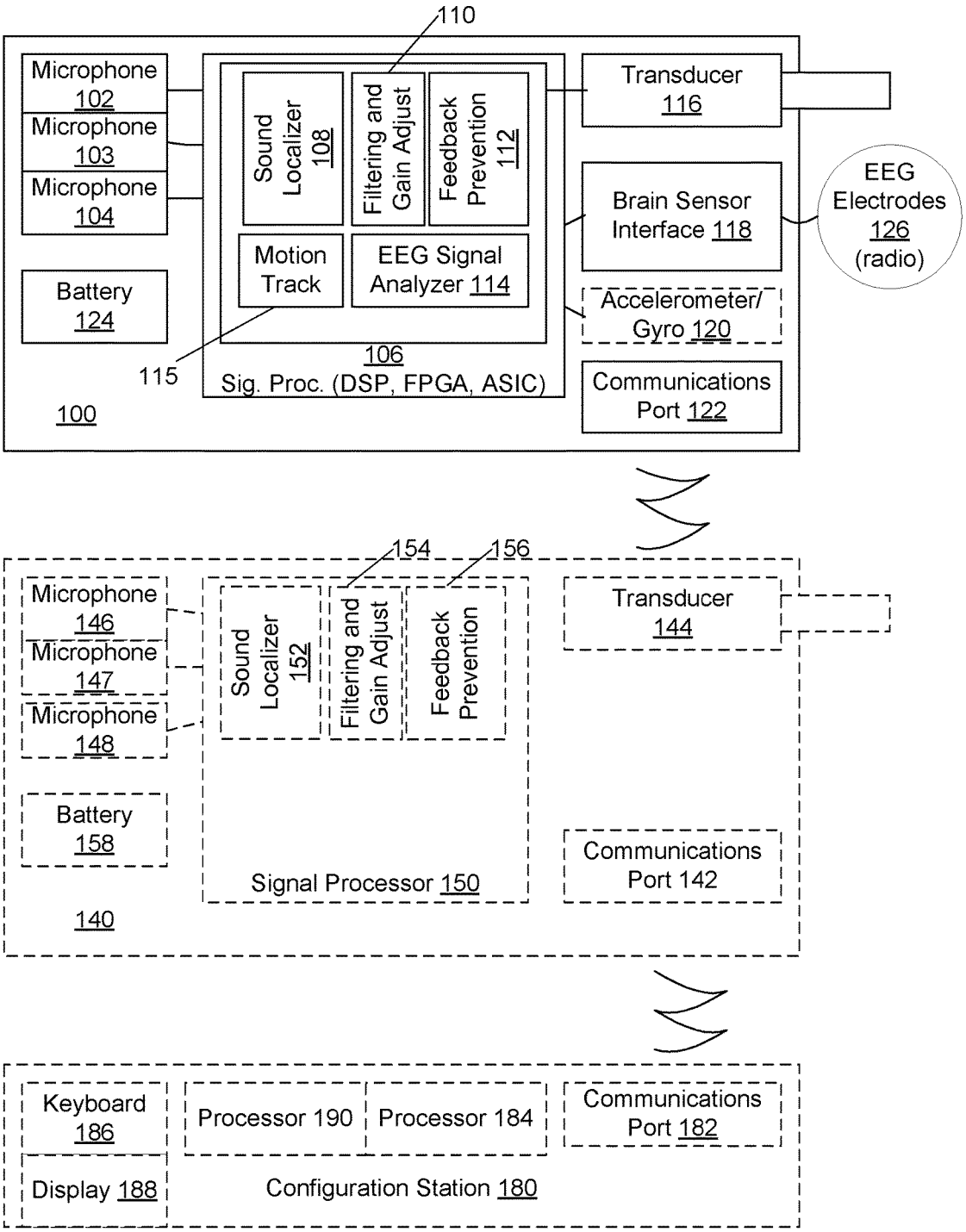
FIG. 1 is a block diagram of an improved directional hearing prosthetic having electroencephalographic control.

An article by the inventors, Valerie Hanson, and Kofi Odame, Real-Time Embedded Implementation of the Binary Mask Algorithm for Hearing Prosthetics, IEEE Trans Biomed Circuits Syst 2013 Nov. 1. Epub 2013 Nov. 1, a draft of which was included as an attachment in U.S. Provisional Patent Application 61/838,032, is incorporated herein by reference. This article illustrates system for selecting and amplifying sound oriented along a direction of current audio focus, and illustrates the effect of such processing on reducing noise from a from a source located other than the current audio focus.

An article by the inventors, Hanson V S, Odame K M: Real-time source separation on a field programmable gate array platform. Conf Proc IEEE Eng Med Biol Soc; 2012; 2012:2925-8 was published for a conference that took place at the end of Aug. 28, 2012-Sep. 1, 2012, a draft of which was included as an attachment in U.S. Provisional Patent Application 61/838,032, is also incorporated herein by reference. This article illustrates implementation of filtering in software on a general purpose machine and in a field-programmable gate array.

A thesis entitled Designing the Next Generation Hearing Aid, by Valerie S. Hanson, submitted Jul. 3, 2013 and defended on Jun. 24, 2013, a draft of which was included as an attachment in U.S. Provisional Patent Application 61/838,032, is also incorporated herein by reference.

A master hearing prosthetic 100 has at least two, and in a particular embodiment three, microphones 102, 103, 104, coupled to provide audio input to a digital signal processor 106 subsystem. The signal processor 106 subsystem in an embodiment includes a digital signal processor subsystem with least one processor and a firmware memory that contains sound localizer 108 firmware, sound filtering and gain control 110 firmware, feedback prevention 112 firmware, EEG analyzer firmware 114, and in some embodiments motion tracking firmware 115, as well as firmware for general operation of the system. In alternative embodiments, portions of the signal processor system, such as firmware for general operation of the hearing prosthetic system, may be implemented on a microprocessor and/or digital signal processor subsystem, and other portions implemented with dedicated logical functional units or circuitry, such as digital filters, implemented in an application-specific integrated circuit (ASIC) or in logical functional units, such as digital filters, implemented in field programmable gate array (FPGA) logic.

The prosthetic 100 also has a transducer 116 for providing processed audio output signals to a user of prosthetic 100, in an embodiment transducer 116 is a speaker as known in the art; in an alternative embodiment it is a coupler to one or more cochlear implants. Prosthetic 100 also has a brain sensor interface 118, in some embodiments an accelerometer/gyroscope motion sensing device 120, and a communications port 122, all coupled to operate under control of, and provide data to, the digital signal processor 106. The prosthetic 100 also has a battery power system 124 coupled to prove power to the digital signal processor 106 and other components of the prosthetic. In use, electroencephalographic electrodes 126 are coupled to the brain sensor interface 118 and to a scalp of a wearer.

Master prosthetic 100 is linked, either directly by wire, or through short-range radio or optical fiber and an electrode interface box 280, to EEG electrodes 126. EEG electrodes 126 include at least one sense electrode 282 and at least one reference electrode 284, electrodes 282, 284, and interface box 280, are preferably concealed in the user's hair or, for balding users, worn under a cap (not shown).

Figure 2:
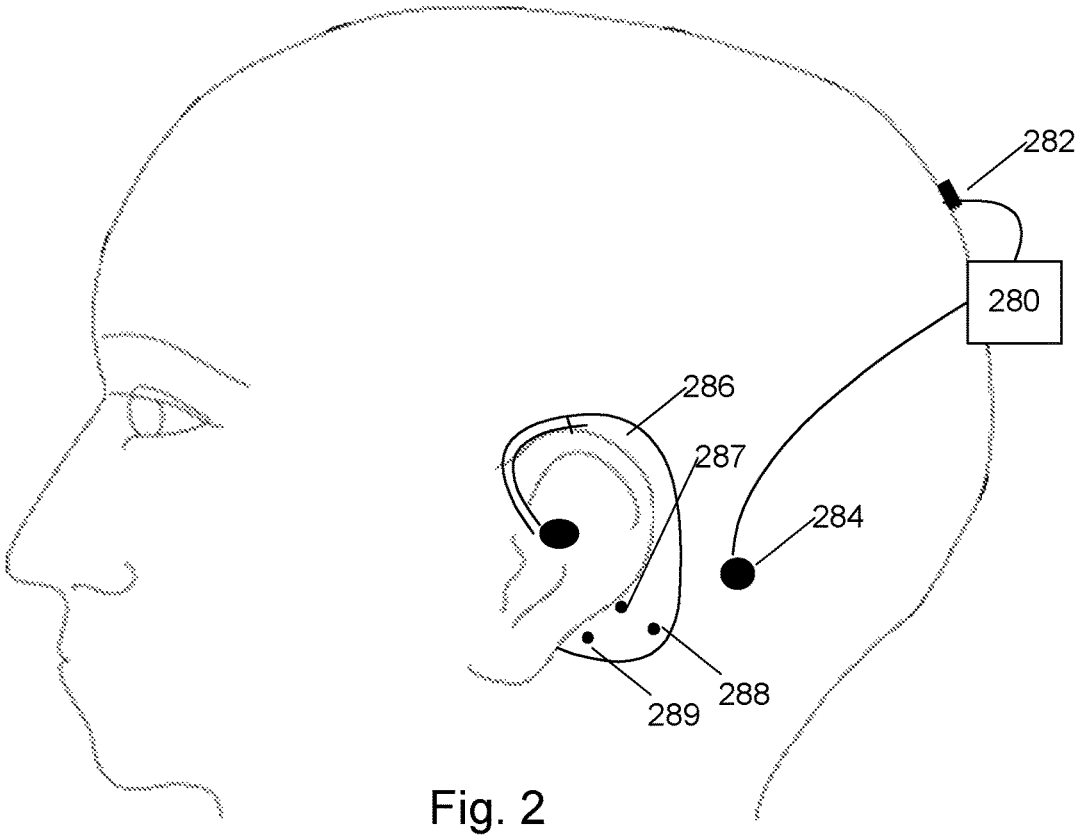
FIG. 2 is an illustration of the Pz electroencephalographic electrode placement position, showing an embodiment having a wireless electrode interface, for obtaining P300 neural feedback.

In an embodiment that uses a "P300" response for control, when a single sense electrode 282 is used, that electrode is preferably located along the sagittal centerline of, and in electrical contact with, the scalp at or near the "Pz" position as known in the art of electroencephalography and as illustrated in FIG. 2. Reference electrode 284 is also in electrical contact with the scalp, and in a particular embodiment is located over the mastoid bone sufficiently posterior to the pinna of an ear that a body 286 of prosthetic 100 may be worn in a behind-ear position without interfering with electrode 284 and with microphones 287, 288, 289 exposed. In alternative embodiments, additional sense electrodes (not shown) are provided for better detecting neural feedback.

In another particular embodiment, one or more sense electrodes, not shown, and associated reference electrodes, are implanted on, or in, audio processing centers of the brain, and wirelessly coupled to master prosthetic 100. In a particular embodiment, the implanted electrodes are electrocorticography (ECoG) electrodes located on the cortex of the user's brain, and processed for P300 signals in a manner similar to that used with EEG electrodes.

Figure 2A:
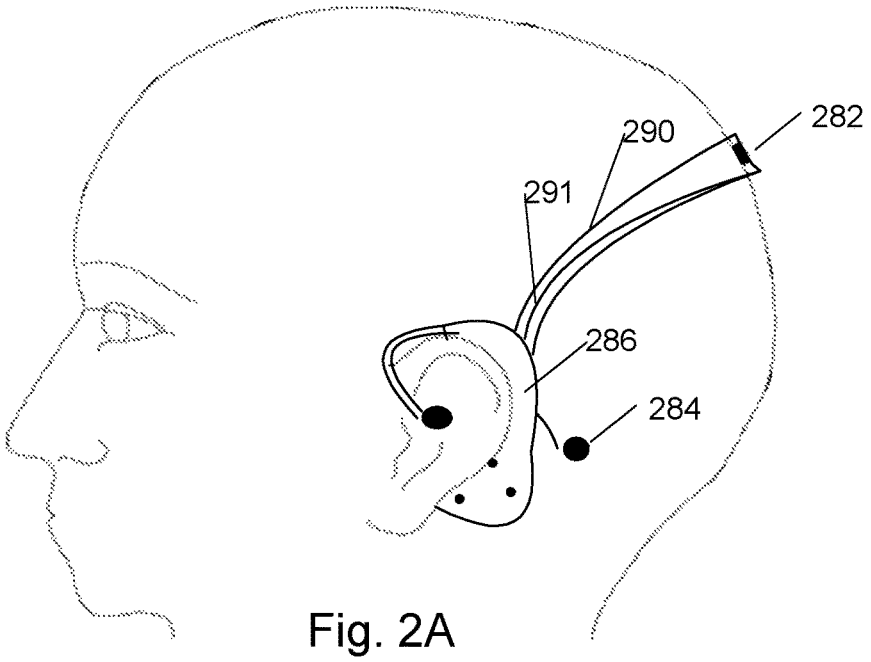
FIG. 2A is an illustration of an alternative embodiment having a headband with direct electrical contact to the scalp electrode.
Figure 2B:
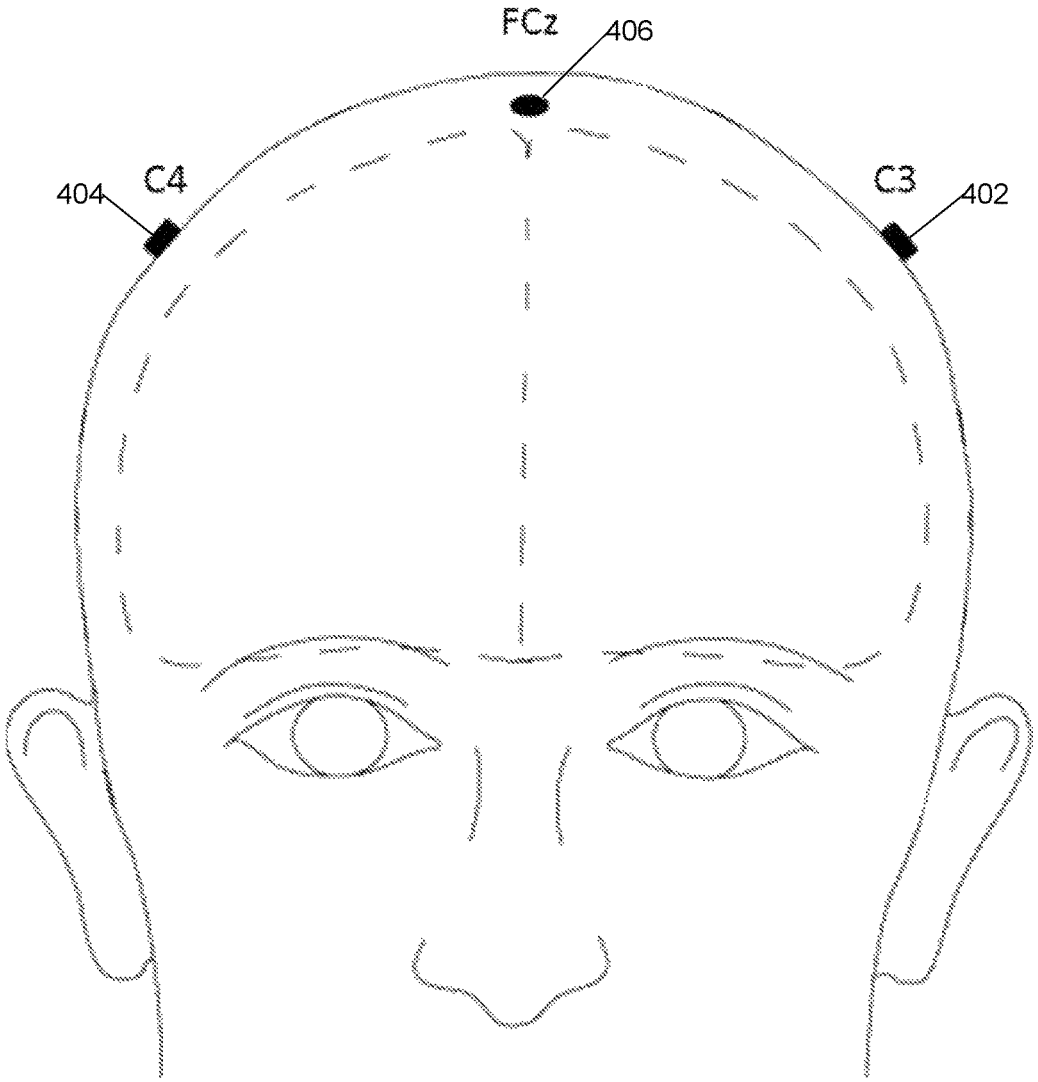
FIG. 2B is an illustration of the C3, C4, and Cz alternative electrode placement for use with motor-cortex sensorimotor-rhythm neural feedback.
Figure 2C:
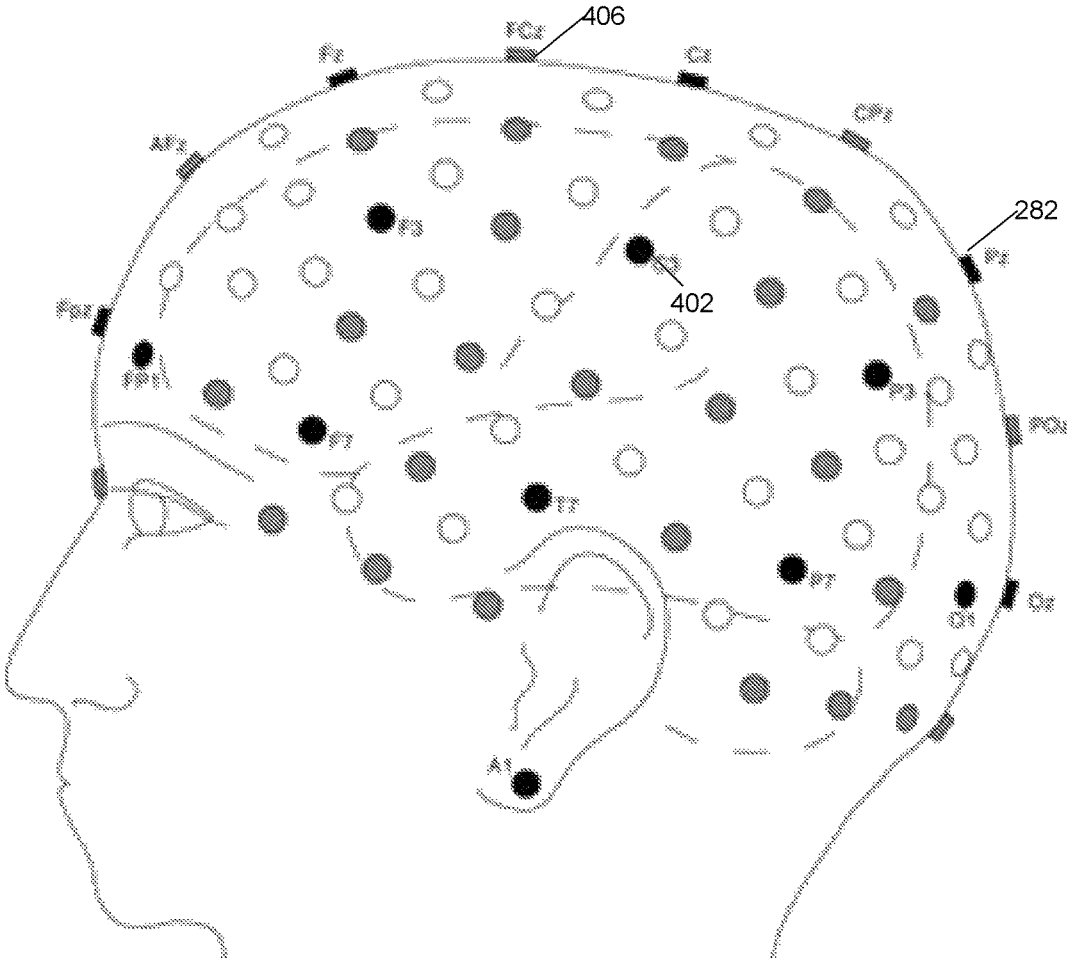
FIG. 2C is an illustration of the Pz and C3, C4, and Cz electrode placements, illustrating their differences.

In an alternative embodiment, as illustrated in FIG. 2A, body 286 of master prosthetic 100 is attached to body (not shown) of slave prosthetic 140 by a headband 290, with electrode 290 attached to the headband. In this embodiment, master prosthetic 100 and slave 140 may communicate between communications ports 122, 142 through an optical fiber 291 or wire routed through the headband.

In some embodiments, including embodiments where the user has amplifier-restorable hearing in only one ear, prosthetic 100 may stand alone without a second, slave, prosthetic 140. In other embodiments, including those where sufficient hearing to benefit from amplification remains in both ears, the prosthetic 100 operates in conjunction with slave prosthetic 140. Slave prosthetic 140 includes at least a communications port 142 configured to be compatible with and communicate with port 122 of master prosthetic 100, and a second transducer 144 for providing processed audio output signals to the user. In some embodiments, the slave prosthetic includes additional microphones 146, 148, and an additional signal processing subsystem 150. Signal processing subsystem 150 has sound localizer firmware or circuitry 152, filtering and gain adjustment firmware or circuitry 154, and feedback prevention firmware or circuitry 156, and a second battery power system 158.

During configuration and adjustment, but not during normal operation, the master prosthetic 100 may also use its communications port 122 to communicate with a communications port 182 of a configuration station 180 that has a processor 184, keyboard 186, display 188, and memory 190. In some embodiments, configuration station 180 is a personal computer with an added communications port.

In an embodiment, communication ports 122, 182, 142 are short range wireless communications ports implementing a pairable communications protocol such as a Bluetooth® (Trademark of Bluetooth Special Interest Group, Kirkland, Wash.) protocol or a Zigbee® (trademark of Zigbee Alliance, San Ramon, Calif.) protocol. Embodiments embodying pairable wireless communications between master and slave prosthetic, between prosthetic and control station, and/or master prosthetic and EEG electrode interface 280, in any combination, permit ready field substitution of components of the hearing prosthetic system as worn by a particular user while avoiding interference with another hearing prosthetic system as worn by a second, nearby, user.

In an alternative embodiment, communications ports 122, 182 operate over a wired connection through a headband. In particular embodiments, the headband also containing EEG electrodes 126, particularly in embodiments where no separate wireless electrode interface 280 is used.

Figure 3:
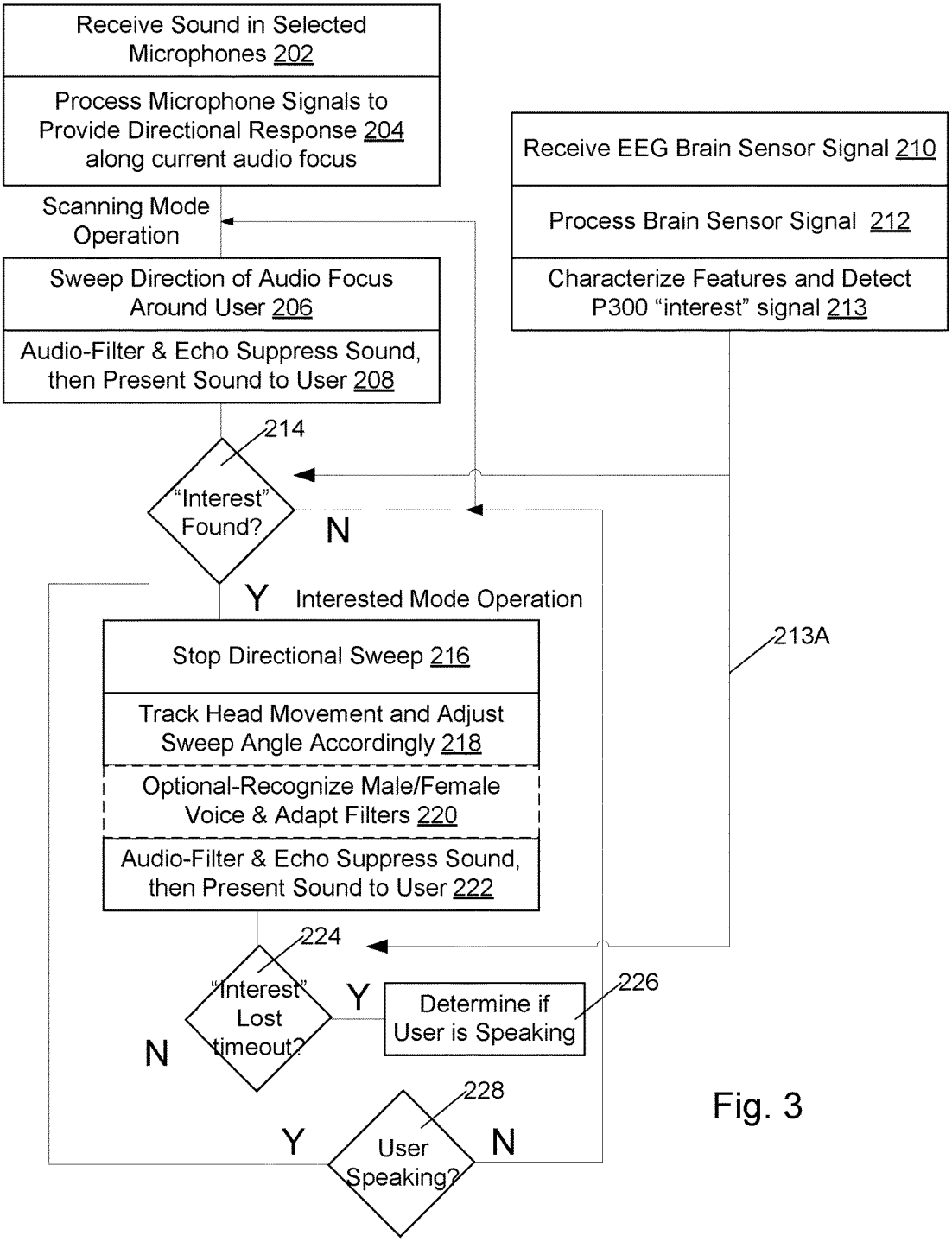
FIG. 3 is a flowchart of a method of focusing a microphone subsystem of a hearing prosthetic at a particular speaker such that the wearer may be able to better understand the speaker.

With reference to FIGS. 1 and 3, during operation, microphones 102, 103, 104, 146, 148, receive 202 sound, this sound has slight phase differences due to variations in time of arrival at each microphone caused by the finite propagation speed of sound and differences in physical location of microphones 102, 103, 104, 146, 148 on the bodies of master 100 and slave 140 prosthetic. In an embodiment, signals from two or more, and in an embodiment 3 or more, microphones are selected from either the microphones 102, 103, 104, on prosthetic 100, or from microphones 146, 147, 148 on slave 140, based upon a current direction of audio focus.

Figure 4:
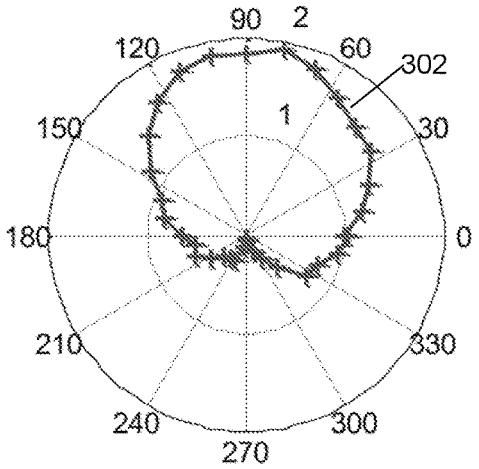
FIG. 4 and FIG. 5 illustrate effectiveness of audio beamforming obtainable by digitally processing signals from two, closely-spaced, microphones.
Figure 5:
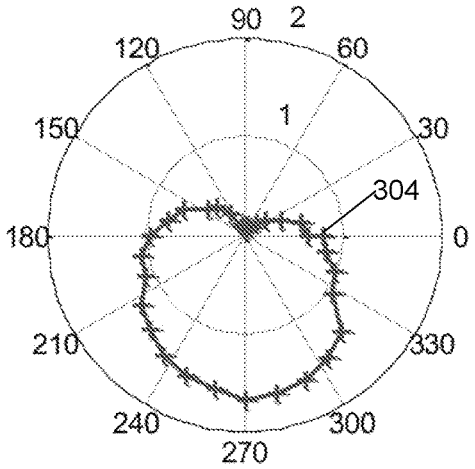

In an embodiment, selected audio signals from more than one microphone of microphones 102, 103, 104, 146, 146, 147, 148 are then processed by signal processor 106, 150 executing sound localizer firmware 108, 152 to use phase differences in sound arrival at the selected microphones to select and amplify audio signals arriving from the current direction of audio focus, and reject at least some audio signals derived from sound arriving from other directions. In a particular embodiment, selecting and amplifying audio signals arriving from the current direction of audio focus, and rejecting at least some audio signals derived from sound arriving from other directions via beamforming, and further noise reduction by removal of competing sounds, is performed by binary masking as described in the draft article Real-Time Embedded Implementation of the Binary Mask Algorithm for Hearing Prosthetics, by Kofi Odame and Valerie Hanson, and incorporated herein by reference. FIGS. 4 and 5 are gain-direction plots showing effective sensitivity 302 when current audio focus is forward and sensitivity 304 when current audio focus is rearward.

Figure 8:
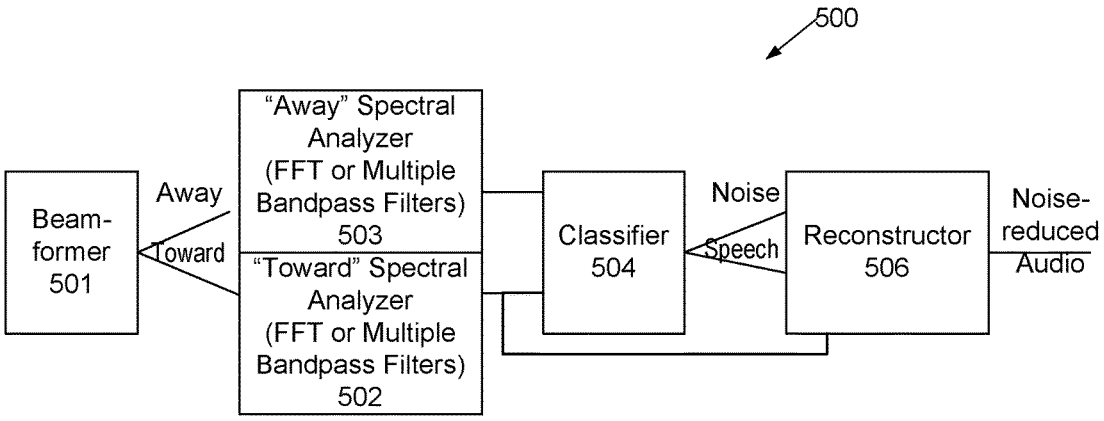
FIG. 8 is a block diagram of a binary masking function of filtering and gain adjustment firmware 110 of FIG. 1.
Figure 9:
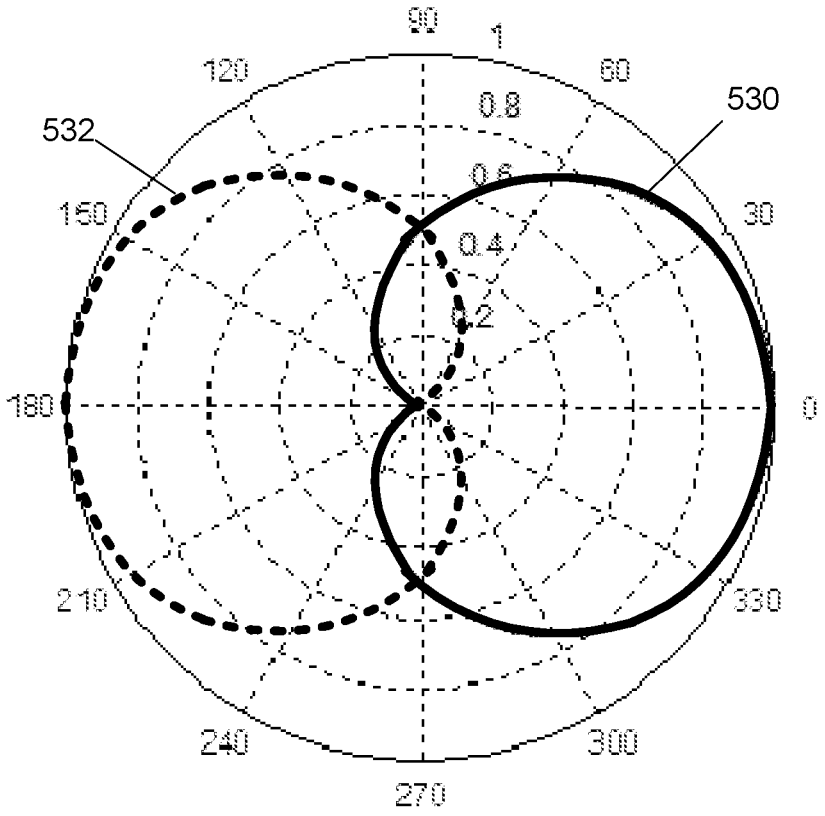
FIG. 9 illustrates cardioid response of the "toward" and "away" beamformer channels of an embodiment.

In an embodiment, binary masking to remove competing sounds is performed by executing a binary masking routine 500 (FIG. 8) portion of filtering and gain adjust firmware 110 using digital signal processing circuitry 106 of prosthetic 100 to perform a spectral analysis 502 of audio signals as processed by a beamforming routine of sound localizer firmware 108. In an embodiment, the beamformer 501 provides two signals, a Toward signal representing audio along the direction of audio focus and having directionality 530 as indicated in FIG. 9, and an Away signal representing audio from a direction opposite the direction of audio focus, or 180 degrees away from the focus, and having directionality 532 as indicated in FIG. 9. The Toward signal has the desired audio signal plus noise, and the Away signal is expected to be essentially noise, as it excludes audio received from the direction of audio focus. In an embodiment spectral analysis is performed by a Toward spectral analyzer 502 and an Away spectral analyzer 503 separately on both the Toward and Away signals with a Fast Fourier Transform (FFT) over a sequence of intervals of time to provide audio in a frequency-time domain, in an embodiment each interval is ten milliseconds. In an alternative embodiment the spectral analyzers 502, 503 is performed for each successive ten millisecond interval of time by executing a bank of several bandpass digital filters for each of the toward and away signals, in a particular embodiment twenty-eight, eighth-order, digital bandpass filters, to provide audio in the frequency-time domain with each filter passband centered at a different frequency in a frequency range suitable for speech comprehension.

In a particular embodiment, our filter bank uses a linear-log approximation of the Bark scale. The filter bank has 7 low-frequency linearly spaced filters, and 21 high-frequency logarithmically spaced filters. The linearly spaced filters span 200 Hz to 935 Hz, and each exhibits a filter bandwidth of 105 Hz. The transition frequency and linear bandwidth features were chosen to keep group delay within acceptable levels. The logarithmically spaced filters cover the range from 1 KHz to a maximum frequency chosen between 7 and 10 KHz, in order to provide better speech comprehension than available with standard 3 KHz telephone circuits. In a particular embodiment, each band-pass filter is composed of a cascade of 4 Direct Form 2 (DF2) SOS filters of the form:

$$w(n)=g\cdot x(n)-a1\cdot w(n-1)-a2\cdot w(n-2)$$

$$y(n)=b0\cdot w(n)+b1\cdot w(n-1)+a2\cdot w(n-2)$$

where g; ai; and bi are the filter coefficients, x(n) is the filter input, y(n) is the output, and w(n);w(n−1); and w(n−2) are delay elements. An amplitude is determined for each filter output for use by the classifier 504.

The frequency-domain results of the spectral analysis for both the toward and away spectral analyzers is then submitted to a classifier 504 that determines whether the predominant sound in each interval for each "Toward" filter channel or corresponding segments of the FFT in FFT-based implementations is speech, or is noise, including impulse noise, based upon an estimate of speech signal to noise ratio determined by computing a signal to noise ratio from amplitudes of each frequency band of the "toward" and "away" channels. In a particular embodiment, the interval is 10 milliseconds. Outputs of the "toward" spectral analyzer 502 are fed to a reconstructor 506 that regenerates audio during intervals classified as speech by performing an inverse fourier transform in embodiments using an FFT-based spectral analyzer 502, or by summing outputs of the "toward" filterbank where a filterbank-based spectral analyzer 502 is used.

In a binary-masked embodiment, audio output from the reconstructor is suppressed for ten millisecond intervals for those frequency bands determined to have low speech to noise ratios, and enabled when speech to noise ratio is high, such that impulse noises and other interfering sounds, including sounds originating from directions other than the direction of audio focus, are suppressed. In an alternate embodiment, the reconstructor repeats reconstruction of an immediately prior interval having high speech to noise ratio during intervals of low speech to noise ratio, thereby replacing noise with speech-related sounds.

Initially, the direction of current audio focus is continually swept 206 in a 360-degree circular sweep around the user. In particular embodiments, the direction of audio focus is aimed in a sequence of 4 directions, left, forward, right, and to the rear, of the user, and remains in each direction for an epoch of time of between one half and one and a half seconds. In an alternative embodiment, six directions, and in yet another embodiment eight, directions are used.

Audio from the current direction of audio focus is then amplified and filtered in accordance with a frequency-gain prescription appropriate for the individual user by the signal processing system executing filtering and gain adjustment firmware 110, 154 to form a filtered audio. The signal processing system 106, 150 executes a feedback prevention firmware 112, 156 on filtered audio to detect and suppress feedback-induced oscillations (often heard as a loud squeal) such as are common with many hearing prosthetics when an object, such as a hand, is positioned near the prosthetic. Depending on the current direction of audio focus, feedback suppressed and filtered audio is then presented by master signal processing system 106 to transducer 116, or transmitted from slave signal processor 150 over slave communications port 142 to master communication port 122 and thence to transducer 116. Similarly, when audio is presented from master processing system to transducer 116, that audio is also transmitted through master communications port 122 to slave communications port 142 and thence to slave transducer 144. When audio is being transmitted from slave port 142 to master port 122 and master transducer 116, that audio is also provided to slave transducer 144. The net result is that amplified and filtered audio along the current direction of audio focus, with audio from other directions reduced, is provided to both master and slave transducers and thereby provided to a user of the device since each transducer is coupled to an ear of the user.

An example of the degree to which audio can be focused along the current axis of audio focus is illustrated in FIGS. 4 and 5.

The signal processing system also receives an EEG signal from EEG electrodes 126 into brain sensor interface 118. Signals from this brain sensor are processed 212 and features are characterized 213 to look for an "interest" signal, also known as a P300 signal 213A, derived as discussed below.

In an alternative embodiment, instead of an EEG signal, an interest signal is derived from an optical brain activity signal. In this embodiment, the optical brain-activity signal is derived by sending light into the skull from a pair of infrared light sources operating at different wavelengths, and determining differences in absorption between the two wavelengths at a photodetector. Since blood flow and oxygenation in active brain areas differs from that in inactive areas and hemoglobin absorption changes with oxygenation, the optical brain-activity signal is produced when differences in absorption between the two wavelengths reaches a particular value.

When 214 the interest signal is detected, and reaches a sweep maximum, the prosthetic enters an interested mode where sweeping 206 of the current direction of audio focus is stopped 216, leaving the current direction of audio focus aimed at a particular audio source, such as a particular speaker that the user wishes to pay attention to. Reception of sound in microphones and processing of audio continues normally after detection of the interest signal, so that audio directionally selected from audio received along the current direction of audio focus continues to be amplified, filtered, and presented to the user 222. It should be noted that the current direction of audio focus is relative to an orientation in space of prosthetic 100.

In some embodiments having optional accelerometers and/or gyro 120, after an interest signal is detected 214, signals from accelerometers and/or gyro 120 are received by signal processing system 100, which executes motion tracking firmware 115 to determine any rotation of a user's head to which prosthetic 100 is attached. In these embodiments, an angle of any such rotation of the user's head is subtracted from the current direction of audio focus such that the direction of audio focus appears constant in three dimensional space even though the orientation of prosthetic 100 changes with head rotation. In this way, if an interest signal is detected from a friend speaking while behind the user- and the current direction of audio focus is aimed at that friend, and the user then turns his head to face the friend, the current direction of audio focus will remain aimed at that friend despite the user's head rotation.

In a particular embodiment, when an interest signal 213A is detected 213, signal processing system 106 determines whether a male or female voice is present along the direction of audio focus, and, if such a voice is present, optimizes filter coefficients of filtering and gain adjust firmware 110 to best support the user's understanding of voices of the detected male or female type.

In order to avoid disruption of a conversation, when 224 the interest signal 213A is lost, the signal processing system 106 determines 226 if the user is speaking by observing received audio for vocal resonances typical of the user. If 228 the user is speaking, the user is treated as having continued interest in the received audio. If 228 the user is no longer interested and not speaking, then after a timeout of a predetermined interval the sweeping 206 rotation of the current audio focus restarts and the prosthetic returns to an un-interested, scanning, mode.

Figure 6:
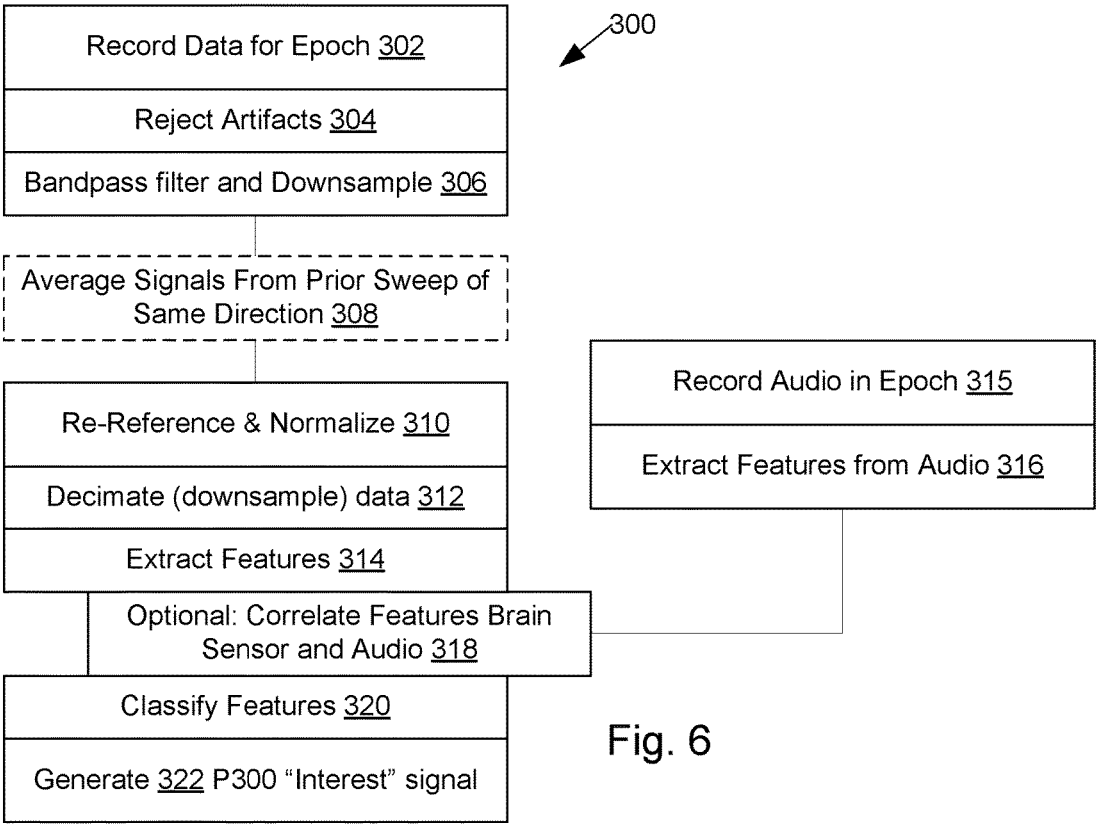
FIG. 6 is a flowchart illustrating determination of the P300, or "Interest", neural feedback signal from electroencephalographic sensor information.

In an embodiment, steps Process Brain Sensor Signal 212 and Characterize Features and Detect P300 "Interest" signal 213 as illustrated in FIG. 6. This processing 300 begins with digitally recording 302 the EEG or brain signal data as received by brain sensor interface 118 for an epoch, an epoch being typically is a time interval of less than one to two seconds during which the direction of audio focus remains in a particular direction. Recorded data is processed to detect artifacts, such as signals from muscles and other noise, and, if data is contaminated with such artifacts, data from that epoch is rejected 304. Data is then bandpass-filtered by finite-impulse-response digital filtering, and downsampled 306.

In a particular embodiment that determines a direction of interest by recording an epoch of sound and replaying it to the user in two or more successive epochs, or two or more epochs in successive sweeps, downsampled brain sensor data may optionally be averaged 308 to help eliminate noise and to help resolve an "interest" signal.

Downsampled data is re-referenced and normalized 310, and decimated 312 before feature extraction 314.

In a particular embodiment, audio 208 presented to the user is recorded 315, and features are extracted 316 from that audio. In a particular embodiment, feature extraction 316 included one or more of wavelet coefficients, independent component, analysis (ICA), auto-regressive coefficients, features identified from stepwise linear discriminant analysis, and in a particular embodiment the squared correlation coefficient (SCC), a square of the Pearson Product-Moment Correlation Coefficient, using features automatically identified during a calibration phase when the direction of interest is known.

Extracted features are then classified 320 by a trainable classifier such as a KNN (k-Nearest Neighbors), neural networks (NN), linear discriminant analysis (LDA), and support vector machines (SVM) classifiers. In a particular embodiment, a linear SVM classifier was used. Linear SVM classifiers separate data into two classes using a hyperplane. Features must be standardized prior to creating the support vector machine and using this model to classify data. The training data set is used to compute the mean and standard deviation for each feature. These statistics are then used to normalize both training data and test data. Matlab compatible LIBSVM tools were used to implement the SVM classifier in an experimental embodiment. The SVM model is formed using the svmtrain function, whereas classification is performed using the svmpredict function.

In an embodiment, since it can take a human brain a finite time, or neural processing delay, to recognize a voice or other audio signal of interest, the classifier is configured to identify extracted features as indicating interest by the user in a time interval of the epoch beginning after a neural processing delay from a time when audio along the direction of audio focus is presented to the user. In a particular embodiment, 300 milliseconds of audio processing delay is allowed.

When the trainable classifier classifies 320 the extracted features as indicating interest on the part of the user, the P300 or "interest" signal 213A is generated 322.

In alternative embodiments, the SCP (slow cortical potential) and SMR (sensorimotor rhythm) embodiments, at least two electrodes, including one electrode located in the C3 position 402 as known in the art of electroencephalograph and the C4 position 404, also as known in the art of electroencephalography, placed on scalp over sensorimotor cortex, or alternatively implanted in sensorimotor cortex, are used instead of, or in addition to, the electrode 282 at the Pz position. In a variation of this embodiment, an additional electrode located at approximately the FCz position is also employed for rereferencing signals. This embodiment may make use of the C3 and C4 electrode signals, and in some embodiments the FCz position.

In embodiments having electrodes at the C3 and C4 electrodes, and in embodiments also having aFCz position electrode, signals received from these electrodes are monitored and subjected to spectral analysis, in an embodiment the spectral analysis is performed through an FFT—a fast Fourier transform—and in another embodiment the spectral analysis is performed by a filterbank. The spectral analysis is performed to determine a signal amplitude at a fundamental frequency of Slow Cortical Potential (SCP) electroencephalographic waves in sensorimotor cortex underlying these electrodes. In these embodiments, the FFT or filterbank output is presented to a classifier, and amplitude at the SCP frequency is classified by trainable classifier circuitry, such as a kNN classifier, a neural network classifier (NN) or an SVM classifier, into one of a predetermined number of bins, in a particular embodiment four bins. Each bin is associated with a particular direction. Upon the classifier classification of the signal amplitude at the SCP frequency as being within a particular bin, the current direction of audio focus is set to a predetermined direction associated with that bin.

Since it has been shown the amplitude of SCP is trainable in human subjects—that by repeatedly measuring SCP and providing a feedback to subjects, subjects have developed the ability to produce a desired SCP response, a trained user of an SCP embodiment can therefore instruct prosthetic 100 to set the direction of audio focus to a preferred direction; in an embodiment the user can select one of four directions. In a particular embodiment, an electrode 282 is also present at the Pz location, upon detection of the P300, the direction of current audio focus is stabilized. The SCP embodiment as herein described is applicable to both particular embodiments having the C3 and C4 electrodes on a headband connecting the master 100 and slave 140 prosthetics, and to embodiments having a separate EEG sensing unit 280 coupled by short-range radio to master prosthetic 100 and embodiments may also be provided with switchable audio feedback of adjustable volume indicating when effective SCP signals have been detected. In an alternative particular SCP embodiment, two bins are used and operation is as described with the embodiment of FIG. 2 with SCP in a first bin processed as if there was no P300 signal, and SCP in a second bin processed as if there is a P300 signal present in the P300 embodiment previously discussed. Since SCP is trainable, a user can be trained to generate the SCP signal when that user desires an SCP-signal-dependent response by prosthetic 100 and to thereby stop scanning of the direction of audio focus.

In an alternative embodiment, the SMR embodiment, having at least electrodes at the C3 and C4 positions, signals from these electrodes are also filtered, and magnitude at the SCP frequency determined. The amplitude in left C3 and right C4 channels are compared, and the difference between these signals, if any, determined. In a particular SMR embodiment, detection of a C3 signal as much stronger than a C4 signal sets the prosthetic 100 to a current direction of audio focus to an angle to 45 degrees left of forward, detection of a C4 signal as much stronger than a C3 signal sets the prosthetic to a current direction of audio focus to an angle 45 degrees to the right of forward, and equal C3 and C4 signals to a direction of forward. In an alternative SMR embodiment, three bins are used and operation is as described with the embodiment of FIG. 2 with SMR in a first bin, such as a left C3-dominant bin, processed as if there was no P300 signal to permit scanning of the direction of interest, and SMR in a second bin, such as a right C4-dominant bin, processed as if there is a P300 signal present in that figure; a third bin indicates neither left nor right. The direction of audio focus is then set to a direction indicated by the bin.

In an alternative embodiment, instead of setting the direction of audio focus to a left angle upon detection of SMR in the left-dominant bin, and setting the direction of audio focus to a right angle upon detection of SMR in the right-dominant bin, these signals are used to steer the direction of interest by subtracting a predetermined increment from a current direction of audio focus when SMR in the left-dominant bin is detected, and adding the predetermined increment to the current direction of audio focus when SMR in the right-dominant bin is detected. Using this embodiment, a user can steer the direction of audio focus to any desired direction.

Figure 7:
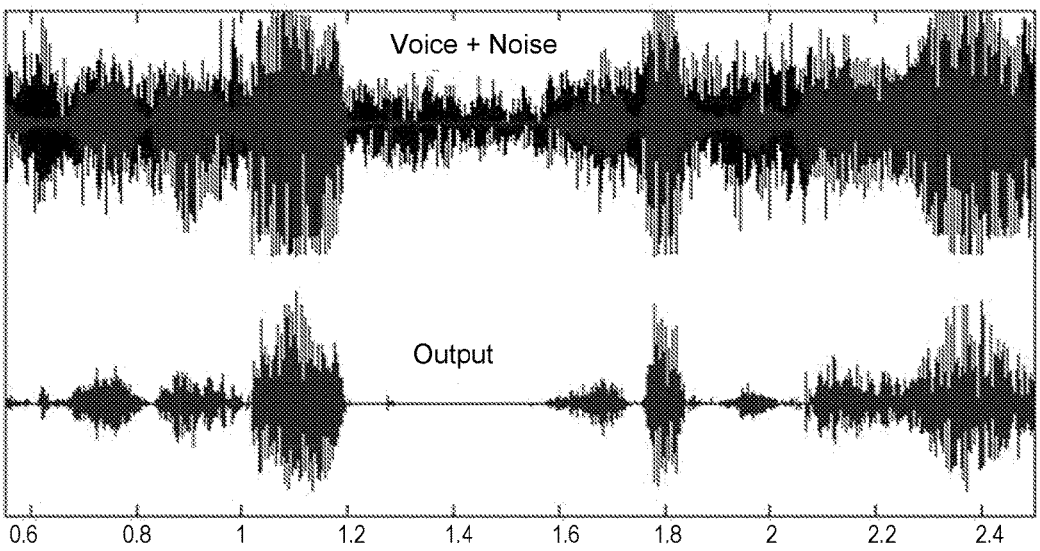
FIG. 7 illustrates the efficacy of the processing herein described at reducing noise presented to a user of the hearing prosthetic.

An embodiment of the present hearing prosthetic, when random noise is provided from a first direction, and a voice presented from a second direction not aligned with the first direction, is effective at reducing noise presented to a user as illustrated in FIG. 7. The upper line "Voice+Noise" represents sound as received by an omnidirectional microphone. The lower line "Output" represents an audio signal provided to transducers 116, 144 when prosthetic 100 has scanned directional reception, a user has concentrated on the voice when the user heard the voice, the prosthetic has detected a P300 or "interest" signal from signals received by brain sensor interface 118 while the user heard the voice, and the prosthetic 100 has entered interested-mode with the direction of audio focus aimed at the second direction—the direction of the voice. The digital signal processor 106 therefore operates as a noise suppression system controlled by neural signals detected by brain sensor interface 118.

It is anticipated that further enhancements may include an adjustment to the direction of audio focus control hardware and methods herein described with cognitive load detection as described in PCT/EP2008/068139, which describes detection of a current cognitive load through electroencephalographic electrodes placed on a hearing-aid user.

Combinations

Various portions of the apparatus and methods herein described may be included in any particular product. For example, any one of the neural interfaces, including the EEG electrode signals analyzed according to P300 or according to the sensorimotor signals SMR or SCP, or the optical brain activity sensor, can be combined with apparatus for selecting audio along a direction of audio focus and setting the direction of audio focus by a either a left-right increment, or according to a timed stop of a scanning audio focus, or to a particular direction determined by the neural signal Similarly, any of the combinations of neural interface, and apparatus for selecting audio along the direction of audio focus may be combined with or without apparatus for further noise reduction, which may include the binary masking described above.

A hearing prosthetic designated A has at least two microphones configured to receive audio; apparatus configured to receive a signal derived from a neural interface, and signal processing circuitry to determine an interest signal when the user is interested in processed audio. The signal processing circuitry is also configured to produce processed audio by reducing noise in received audio, the signal processing circuitry for providing processed audio is controlled by the interest signal; and transducer apparatus configured to present processed audio to a user.

A hearing prosthetic designated AA including the hearing prosthetic designated A wherein the neural interface comprises at least one electroencephalographic electrode.

A hearing prosthetic designated AB including the hearing prosthetic designated AA wherein the signal processing circuitry is configured to determine the interest signal by a method comprising determining a P300 signal.

A hearing prosthetic designated AC including the hearing prosthetic designated A, AA, or AB wherein the signal processing circuitry is configured to determine the interest signal by a method comprising determining a sensorimotor signal.

A hearing prosthetic designated AD including the hearing prosthetic designated A wherein the neural interface comprises an optical brain-activity sensing apparatus.

A hearing prosthetic designated AE including the hearing prosthetic designated A, AA, AB, AC, AD, or AE wherein the signal processing circuitry is configured to operate by preferentially receiving sound from along a direction of audio focus, while rejecting sound from at least one direction not along the direction of audio focus, and wherein the signal processing circuitry is configured to select the direction of audio focus according to the interest signal.

A hearing prosthetic designated AF including the hearing prosthetic designated A, AA, AB, AC, AD, AE, or AF wherein the signal processing circuitry is further configured to reduce perceived noise by performing a spectral analysis of sound received from along the direction of audio focus in intervals of time to provide sound in a frequency-time domain; classifying the received sounds in the interval of time as one of the group consisting of noise and speech; and reconstructing noise-suppressed audio by excluding intervals classified as noise while reconstructing audio from the sound in frequency-time domain.

A hearing prosthetic designated AG including the hearing prosthetic designated AF wherein classifying sounds in the interval of time as one of the group consisting of noise and speech is done by a method including deriving an additional audio signal focused away from the direction of audio focus; performing spectral analysis of the additional audio signal; and determining a signal to noise ratio from a spectral analysis of the additional audio signal and the sound in frequency-time domain; and wherein the intervals excluded as noise are determined from the signal to noise ratio.

A hearing prosthetic designated B includes signal processing circuitry configured to receive audio along a direction of audio focus while rejecting at least some audio received from at least one direction not along the direction of audio focus, the signal processing circuitry configured to derive processed audio from received audio; transducer apparatus configured to present processed audio to a user; and the signal processing circuitry is further configured to receive a signal derived from an electroencephalographic electrode attached to a user, and to determine an interest signal when the user is interested in processed audio.

A hearing prosthetic designated BA including the hearing prosthetic designated B, wherein the prosthetic is adapted to rotate the direction of audio focus when the interest signal is not present, and to stabilize the direction of audio focus when the interest signal is present.

A hearing prosthetic designated BB including the hearing prosthetic designated B, wherein the interest signal comprises a left and a right directive signal, and the prosthetic is adapted to adjust the direction of audio focus according to the left and right directive signals A hearing prosthetic designated BC including the hearing prosthetic designated B, BA, or BB, wherein the signal processing circuitry is further configured to suppress at least some noise in the audio received from the direction of audio focus.

A method designated C of processing audio signals in a hearing aid includes processing neural signals to determine a control signal; receiving audio; processing the received audio according to a current configuration; and adjusting the current configuration in accordance with the control signal.

A method designated CA including the method designated C wherein the neural signals are electroencephalographic signals, and processing the audio according to a current configuration comprises processing audio received from multiple microphones to select audio received from a particular axis of audio focus of the current configuration.

A method designated CB including the method designated C wherein processing of the audio to enhance audio received from a particular axis of audio focus further includes binary masking.

A method designated CC including the method designated C, CA, or CB, wherein the neural signals include electroencephalographic signals from an electrode located along a line extending along a centerline of a crown of a user's scalp, and processed to determine a P300 interest signal.

A method designated CD including the method designated C, CA, or CB, wherein the neural signals include electroencephalographic signals from at least two electrodes located on opposite sides of a line extending along a centerline of the scalp, and processed to determine a sensorimotor signal.

While the invention has been particularly shown and described with reference to specific embodiments thereof, it will be understood by those skilled in the art that various other changes in the form and details may be made without departing from the spirit and scope of the invention. It is to be understood that various changes may be made in adapting the invention to different embodiments without departing from the broader inventive concepts disclosed herein and comprehended by the claims that follow.

What is claimed is:

1. A hearing prosthetic comprising:

at least two microphones configured to receive audio;

apparatus configured to receive a signal derived from a neural interface, and signal processing circuitry to determine an interest signal when the user is interested in processed audio;

the signal processing circuitry being further configured to produce processed audio by reducing noise in received audio, the signal processing circuitry controlled by the interest signal; and transducer apparatus configured to present processed audio to a user;

wherein the neural interface comprises at least one electroencephalographic electrode; and wherein the signal processing circuitry is configured to determine the interest signal by a method comprising determining a P300 signal.

2. A hearing prosthetic comprising:

at least two microphones configured to receive audio;

apparatus configured to receive a signal derived from a neural interface, and signal processing circuitry to determine an interest signal when the user is interested in processed audio;

the signal processing circuitry being further configured to produce processed audio by reducing noise in received audio, the signal processing circuitry controlled by the interest signal; and transducer apparatus configured to present processed audio to a user;

wherein the neural interface comprises at least one electroencephalographic electrode; and wherein the signal processing circuitry is configured to determine the interest signal by a method comprising determining a sensorimotor signal.

3. A hearing prosthetic comprising:

at least two microphones configured to receive audio;

apparatus configured to receive a signal derived from a neural interface, and signal processing circuitry to determine an interest signal from the signal derived from the neural interface when the user is interested in processed audio;

the signal processing circuitry being further configured to produce processed audio by reducing noise in received audio, the signal processing circuitry controlled by the interest signal; and transducer apparatus configured to present processed audio to a user;

wherein the neural interface comprises a brain-activity sensing apparatus, and wherein the signal processing circuitry is configured to operate by preferentially receiving sound from along a direction of audio focus, while rejecting sound from at least one direction not along the direction of audio focus, and wherein the signal processing circuitry is configured to select the direction of audio focus according to the interest signal.

4. The hearing prosthetic of claim 3 wherein the signal processing circuitry is further configured to reduce perceived noise by:

performing a spectral analysis of sound received from along the direction of audio focus in intervals of time to provide sound in a frequency-time domain;

classifying the received sounds in the interval of time as one of the group consisting of noise and speech; and reconstructing noise-suppressed audio by excluding intervals classified as noise while reconstructing audio from the sound in frequency-time domain.

5. A hearing prosthetic comprising:

at least two microphones configured to receive audio;

apparatus configured to receive a signal derived from a neural interface, and signal processing circuitry to determine an interest signal when the user is interested in processed audio;

the signal processing circuitry being further configured to produce processed audio by reducing noise in received audio, the signal processing circuitry controlled by the interest signal; and transducer apparatus configured to present processed audio to a user;

wherein the neural interface comprises at least one electroencephalographic electrode;

wherein the signal processing circuitry is configured to operate by preferentially receiving sound from along a direction of audio focus, while rejecting sound from at least one direction not along the direction of audio focus, and wherein the signal processing circuitry is configured to select the direction of audio focus according to the interest signal;

wherein the signal processing circuitry is further configured to reduce perceived noise by:

performing a spectral analysis of sound received from along the direction of audio focus in intervals of time to provide sound in a frequency-time domain;

classifying the received sounds in the interval of time as one of the group consisting of noise and speech; and reconstructing noise-suppressed audio by excluding intervals classified as noise while reconstructing audio from the sound in frequency-time domain; and wherein classifying sounds in the interval of time as one of the group consisting of noise and speech is done by a method comprising:

deriving an additional audio signal focused away from the direction of audio focus;

performing spectral analysis of the additional audio signal; and

Determining a signal to noise ratio from a spectral analysis of the additional audio signal and the sound in frequency-time domain;

wherein the intervals excluded as noise are determined from the signal to noise ratio.

6. A method of processing audio signals in a hearing aid comprising:

processing neural signals to determine a control signal;

receiving audio;

processing the received audio according to a current configuration;

adjusting the current configuration in accordance with the control signal;

wherein the neural signals are electroencephalographic signals, and processing the audio according to a current configuration comprises processing audio received from multiple microphones to select audio received from a particular axis of audio focus of the current configuration;

wherein processing of the audio to enhance audio received from a particular axis of audio focus further comprises binary masking.

7. A method of processing audio signals in a hearing aid comprising:

processing neural signals to determine a control signal;

receiving audio;

processing the received audio according to a current configuration;

adjusting the current configuration in accordance with the control signal;

wherein the neural signals are electroencephalographic signals, and processing the audio according to a current configuration comprises processing audio received from multiple microphones to select audio received from a particular axis of audio focus of the current configuration;

wherein the neural signals include electroencephalographic signals from an electrode located along a line extending along a centerline of a crown of a user's scalp, and processed to determine a P300 interest signal.

8. A method of processing audio signals in a hearing aid comprising:

processing neural signals to determine a control signal;

receiving audio;

processing the received audio according to a current configuration;

adjusting the current configuration in accordance with the control signal;

wherein the neural signals are electroencephalographic signals, and processing the audio according to a current configuration comprises processing audio received from multiple microphones to select audio received from a particular axis of audio focus of the current configuration;

wherein the neural signals include electroencephalographic signals from at least two electrodes located on opposite sides of a line extending along a centerline of the scalp, and processed to determine a sensorimotor signal.

9. The hearing prosthetic of claim 1 wherein the signal processing circuitry is configured to operate by preferentially receiving sound from along a direction of audio focus, while rejecting sound from at least one direction not along the direction of audio focus, and wherein the signal processing circuitry is configured to select the direction of audio focus according to the interest signal.

10. The hearing prosthetic of claim 2 wherein the signal processing circuitry is configured to operate by preferentially receiving sound from along a direction of audio focus, while rejecting sound from at least one direction not along the direction of audio focus, and wherein the signal processing circuitry is configured to select the direction of audio focus according to the interest signal.

* * * * *